United States Patent [19]

Gerhardt et al.

[11] Patent Number: 4,933,658

[45] Date of Patent: Jun. 12, 1990

[54] HIGH TEMPERATURE FLUID SENSOR

[75] Inventors: Don J. Gerhardt, Clemmons; Randal A. Little, Mocksville; F. William Capp, Winston-Salem, all of N.C.

[73] Assignee: Ingersoll-Rand Company, Woodcliff Lake, N.J.

[21] Appl. No.: 350,006

[22] Filed: May 10, 1989

[51] Int. Cl.[5] ..... H01H 37/76

[52] U.S. Cl. ..... 337/405; 337/404

[58] Field of Search ..... 337/405, 404, 403, 402, 337/406, 414

[56] References Cited

U.S. PATENT DOCUMENTS 3,652,195 3/1972 McIntosh et al. ..... 337/404
4,398,785 8/1983 Hedrick .
4,483,811 11/1984 Hirata .
4,632,798 12/1986 Eickman et al. .
4,728,698 3/1988 Isayev .

*Primary Examiner*—H. Broome
*Attorney, Agent, or Firm*—J. R. Bell

[57] ABSTRACT

A high temperature fluid sensor has a fusible detector including a body having longitudinally extending conductors therein. A first portion of the conductors is confined within the body whereas a second portion of the conductors projects from an end of the body. The second conductor portions are spaced-apart to define a void therebetween. A fusible material is engaged with, and electrically bridges between the second conductor portions. A tapered portion of the sensor permits the molten fusible material to flow away from the second conductor portions. The tapered portion terminates in spaced-apart relationship with the fusible material and thus further defines the void.

7 Claims, 2 Drawing Sheets

HIGH TEMPERATURE FLUID SENSOR

BACKGROUND OF THE INVENTION

This invention relates generally to high-temperature sensing devices for use in environments in which there are fluids susceptible of high temperatures, such as a vessel or pipe that is pressurized with air, gas or a liquid, and in particular to a high-temperature fluid sensor having a fusible detector.

High-temperature-fluid sensors are currently available for use in the aforesaid environments, that include high pressure applications, which use a mechanical switch activated by heat. Such sensors have limited response time. There are known high-temperature fluid sensing devices that have fusible links, and these exhibit improved response time.

A limitation, however, is that such sensors having fusible links are not suitable for sensing temperature in still air since the fusible material, in a molten state, may not satisfactorily flow from between the conductor thus causing an inadvertent short circuit.

The foregoing illustrates limitations known to exist in present devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a high-temperature fluid sensor with a fusible detector including a body having a longitudinal axis. A pair of electrical conductors have a first portion confined within the body and lie generally parallel with the axis. A second portion of the conductors projects from one axial end of the body. The second conductor portions are spaced-apart and define a void therebetween. A fusible material is engaged with, and electrically bridges between the second conductor portions. Means such as a tapered portion permits the fusible material, when in the molten state, to flow away from the second portion of the conductors. The tapered portion terminates in spaced-apart relationship with the fusible material and thus further defines the void.

The foregoing and other aspects will become apparent from the following detailed description of the invention when considered in conjunction with the accompanying drawing figures. It is to be expressly understood, however, that the drawing figures are not intended as a definition of the invention but are for the purpose of illustration only.

BRIEF DESCRIPTION OF THE DRAWING FIGURES

Figure 5:
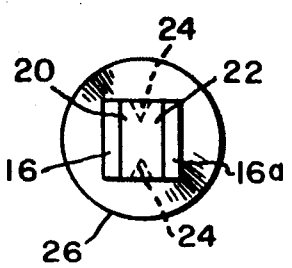
FIG. 5 (PRIOR ART)
FIG. 5 is a view of the stub portion taken along line 5—5 of FIG. 4.
Figure 4:
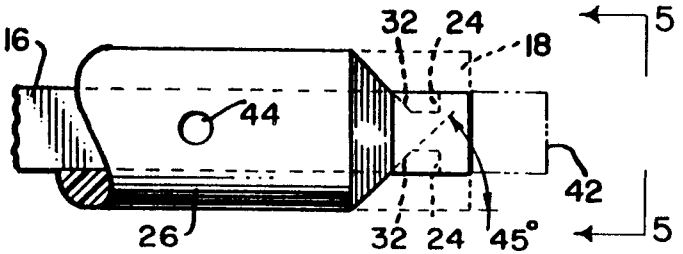
FIG. 4 (PRIOR ART)
FIG. 4 is an enlarged side view illustrating an embodiment of the prior art stub portion of the sensor of FIG. 1 with fusible material shown in phantom.
Figure 6:
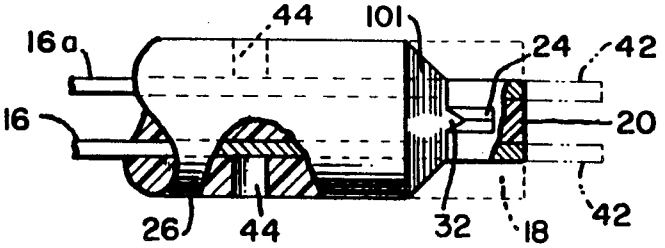
FIG. 6 (PRIOR ART)
Figure 3:
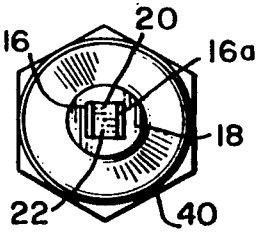
FIG. 3 (PRIOR ART)
FIG. 3 is a view of the sensor taken along the line 3—3 of FIG. 1.
Figure 8:
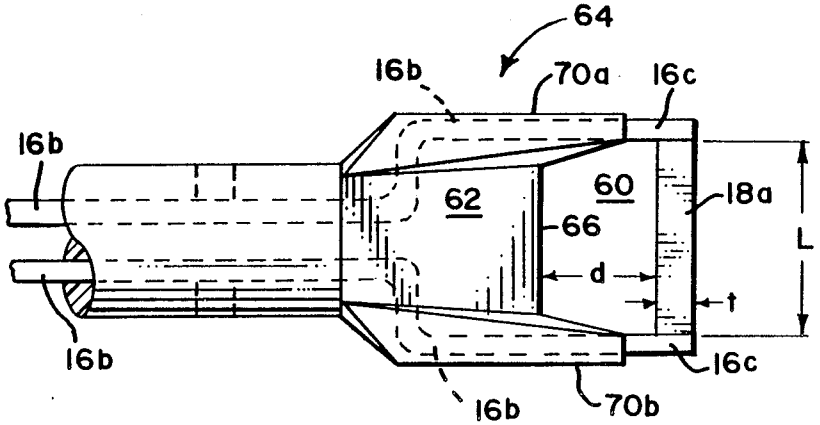
Figure 7:
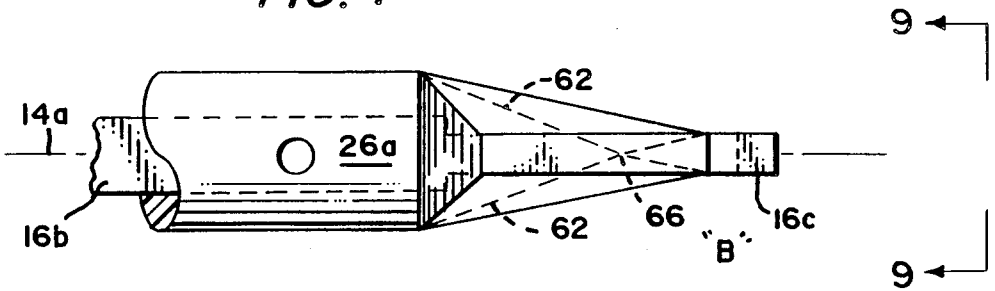

FIG. 6 a top view illustrating the stub portion of FIG. 4;

FIG. 7 is an enlarged side view of an embodiment of the stub portion of the present invention;

FIG. 8 is a top view illustrating the stub portion of FIG. 7; and

Figure 9:
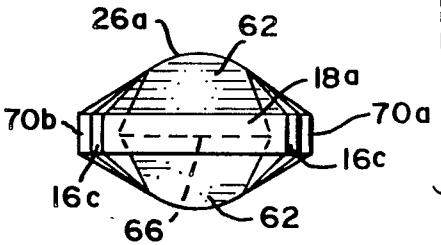

FIG. 9 is a view taken along line 9—9 of FIG. 7.

DETAILED DESCRIPTION

As shown in the figures, a prior art sensor 10, according to an embodiment thereof, comprises an injection-molded body 12, of polymer material, having a longitudinal axis 14. A pair of electrical conductors 16 and **16*a* are confined within the body 12 and lie generally parallel with the axis 14**.

Portions of the conductors 16 and **16*a* project from opposite axial ends, "A" and "B", of the body 12. Fusible electrically conductive material 18 such as a eutectic material formed of about 58% bismuth and 42% tin and having a melting point of 281° F., is engaged with, and electrically bridges across, the projecting portions of conductors 16 and 16*a* at end "B". But there is no fusible material 18 between those projecting portions of conductors 16 and 16*a*. Rather, a buffer 20** of polymer material subsists therebetween for the reasons explained in the following text.

The space or void 22 between the projecting portions of the electrical conductors 16 and **16*a* at the axial end "B" must be filled with an insulating material. If the void 22 is open, or filled with fusible material 18, an electrical conducting path will remain even if the fusible material 18 is in a molten state. A wicking action of molten, fusible material would tend to keep the molten fusible material between the projecting portions of conductors 16 and 16*a*. The void 22 is filled with the polymer buffer 20 during the injection molding of the body 12. The buffer 20 also reduces the mass of the fusible material 18, which improves the response time of the sensor 10** during activation at high temperatures.

The buffer 20 has a mechanical retainer feature, in the form of a V-notch 24, that mechanically locks the fusible sensing material 18 on the small-diameter, stub portion 26 of the sensor 10. The V-notch 24 is superior to a round, square or rectangular notch because it provides for better plastic flow during the injection process, provides a more durable insert on the molding tool, provides better filling of the cavity during the application of the fusible material and places the fusible material 18 closer to the peripheral surface where the reaction time to a high temperature will be quicker.

Figure 1:
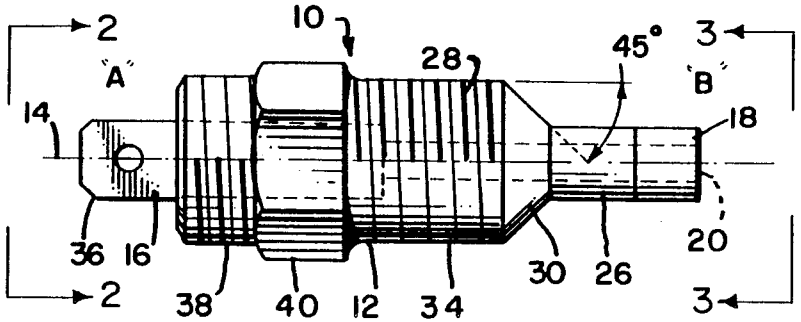
FIG. 1 (PRIOR ART)
FIG. 1 is a side view illustrating an embodiment of a prior art sensor.
Figure 2:
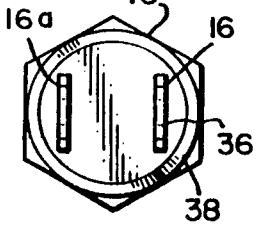
FIG. 2 (PRIOR ART)
FIG. 2 is a view of the sensor taken along the line 2—2 of FIG. 1.

As noted, the body 12 has a small-diameter, stub portion 26; it also has a larger-diameter, shank portion 28, and a transformation portion 30 of tapered configuration. The tapered configuration of portion 30 defines an angled ramp that allows the molten fusible material 18 to flow away from the electrical conductors' projection portions when the sensor 10 is operated in an inverted position. The ramp angle is optimum between thirty and sixty degrees, and the ramp angle is shown at forty-five degrees in FIG. 1. The angled ramp 101 in FIG. 6, also is provided for assisting the molten fusible material 18 to flow away from the electrical conductors.

In the fabrication of the sensor 10, the stub portion 26 is inserted down into a hot mold that will apply the fusible material 18. The molten, fusible material 18 fills the V-notch 24 during this molding process. The notch 24 has an angled ramp 32 at one end to allow any trapped gases to escape during this molding process. The notch ramp angle, too, is optimum between thirty and sixty degrees. The angled ramp of 32 is shown at forty-five degrees, in FIG. 4, and the ramp 32 terminates at an end, and onto the outer surface, of the stub portion 26.

The body 12 has self sealing pipe threads 34, which are used to install the sensor through the wall of a pressure vessel or pipe, formed on the shank portion 28. Electrical connections are made to the spade type electrical terminals 36.

The threaded portion 38 of the body, adjacent to the spade type terminals 36, is used to attach accessories such as a wiring harness, shield connector or a name plate.

The body 12 consists of an injection molded polymer material as earlier noted. It supports the electrical conductors 16 and **16*a*, provides proper spacing thereof at the fusible end "B", provides for proper spacing of the terminals at the connector end "A", provides sealing in a pressure vessel with integral threads 34, contains a hex head 40 for insertion and removal and has the threaded extended head 38 for connecting accessories such as shield adapters or name plates. The body 12 is made from a non-conducting electrical material with a dielectric strength of 400 volts/mil or better per ASTM D-149 so that the conductors 16 and 16*a* do not have to be insulated or isolated from the body. The sensor 10** may be used in a pressurized or non-pressurized environment.

Specifically, the body is constructed, in this embodiment, of polyetherimide resin, with from ten to forty percent of glass reinforcement dispersed therein. Alternatively, polyphenylene sulfide or a liquid crystal polymer may be used; any of these polymers provides good sealing characteristics so that the use of external sealants for the threads is not required in many applications. The glass reinforcement provides high strength at elevated temperatures.

As can be appreciated, the contour of the fusible material 18 is that of a cylindrical shell. This contour has the following redeeming features:

a. It has a high surface-to-volume ratio which promotes good heat transfer and rapid response time when melting;

b. It has a good aerodynamic shape for low drag, the air or gas velocities thereat could exceed 350 mph, and the cylindrical shape reduces aerodynamic erosion;

c. The external contour is symmetrical so its performance does not depend on its orientation; and d. Fusible material is easy to apply and mold in a cylindrical contour.

The electrical conductors 16 and **16*a* must be precisely located during the injection molding of the body 12. It is difficult to hold the conductors at the tip end "B" and be able to inject plastic therebetween all the way to the end. The conductors 16 and 16*a* are extended (approx. 0.125") to allow tools to hold the conductors in precise alignment during injection molding. The 0.125" tips of the conductors are then cut off, prior to application of the fusible material 18. These extensions 42 are shown in phantom in FIGS. 4 and 6**.

It is desirable to have the diameter of the stub portion 26 to be as small as possible to reduce costs and to minimize the aerodynamic influence on the air or fluid flowing across the sensor 10. The clearance between the conductors 16 and **16*a* and the wall of the stub portion 26 has to be controlled. There is a natural tendency for the injected plastic to push the conductors 16 and 16*a* out close to the wall. This sensor 10 accommodates the use of pins in the tooling that control the outward movement of the conductors 16 and 16*a* during the injection process. Pin holes 44 are formed in sides of the stub portion 26** for the tooling pins.

In the present invention as illustrated in the embodiment of FIGS. 7, 8 and 9, stub portion **26*a* includes a body having a longitudinal axis 14*a*. A pair of electrical conductors include a first portion 16*b* confined within stub 26*a*, and lying generally parallel with axis 14*a*. First portion 16*b* is bifurcated to define a pair of extensions 70*a*, 70*b***.

A second portion **16*c* of the conductors is not so confined and projects from axial end "B" of stub 26*a*. Second portions 16*c* are spaced-apart, in juxtaposition, and define a void 60 therebetween. A fusible material 18*a*, having a predetermined thickness "t", and formed of the above-mentioned electrically conductive material, bridges between second conductor portions 16*c*. The second portion 16*c* is bifurcated to form protruding extensions. A ramp or tapered portion 62 of stub 26*a*, is between a widened section 64 of stub 26*a*, wherein first conductor portions 16*b* are confined. Tapered portion 62 terminates at a position designated 66 which is spaced-apart from fusible material 18*a* by a distance "d", thus further defining void 60. Distance "d" is predetermined to be greater than twice the thickness "t". Thus the extensions 70*a*, 70*b*, the second conductor portions 16*c*, the fusible material 18*a* and the terminal end 66 of ramp 62, peripherally enclose void 60. By providing distance "d" greater than twice the thickness "t", adequate room is provided for the molten fusible material 18*a* to flow clear of second conductor portion 16*c***.

As a result, tapered portion 62 provides a means for permitting fusible material **18*a*, in a molten state, with stub 26*a* being in an upright position, that is, rotated 90 degrees counterclockwise from the position illustration in FIG. 8, to flow away from second portions 16*c* of the electrical conductors. This limits the possibility of molten fusible material from lodging between second portions 16*c* and inadvertently forming a short electrical circuit as the molten material 18*a* flows downwardly along ramp 62. The polymer material of which stub 26*a* is formed, confines first portion 16*b* of the conductors thus further limiting an electrical short circuit even if some of the molten fusible material 18*a* remains at the terminal position 66 of ramp 62**.

A length "L" of fusible material **18*a* is preferably 0.25 inches or greater to permit fusible material 18*a* to flow clear of electrode portions 16*c* for all sensor orientations, since fusible material 18*a* has a wicking characteristic as described above. The mass of fusible material 18*a* must be great enough so that the action of gravity pulls fusible material 18*a* away from electrode portions 16*c*. Also, the size of fusible material 18*a*** must be large enough to provide good mechanical strength and electrical current carrying capability while also being small enough to provide a rapid response time.

While this invention has been illustrated and described in accordance with a preferred embodiment, it is recognized that variations and changes may be made therein without departing from the invention as set forth in the claims.

What is claimed is:

1. A high-temperature-fluid sensor, with a fusible detector, comprising:

a body having a longitudinal axis;

a pair of electrical conductors, a first portion of which is confined within said body, lying generally parallel with said axis;

a second portion of said conductors, of said pair thereof, projecting from one axial end of said body;

said second conductor portions, which project from said one end of said body, are spaced-apart, in juxtaposition, defining a void therebetween;

a fusible, electrically-conductive material engaged with, and electrically bridging between said second conductor portions, which project from said one end; and means for permitting said fusible material, when in a molten state, to flow away from said second portion of said conductors, said means including a tapered portion between the first portion of the conductors confined within the body, the tapered portion leading said fusible material, when in a molten state, away from the conductors, the tapered portion terminating in spaced-apart relationship with the fusible material further defining the void.

2. A high-temperature-fluid sensor, with a fusible detector, comprising:

a body having a longitudinal axis;

a bifurcated pair of electrical conductors, a first portion of each of the pair being confined within said body, lying generally parallel with said axis;

a second portion of each of said conductors, of said pair thereof, projecting from one axial end of said body;

said second conductor portions, which project from said one end of said body, are spaced-apart, in juxtaposition, defining a void therebetween;

a fusible, electrically-conductive material engaged with, and electrically bridging between said second conductor portions, which project from said one end; and said body including a tapered portion between the first portion of the conductors confined within the body, said tapered portion terminating in spaced-apart relationship with the fusible material further defining the void.

3. The sensor as defined in claim 2, wherein said body is formed of a polymer material.

4. The sensor as defined in claim 2, wherein said fusible material is of a predetermined thickness and said tapered portion terminates at a predetermined distance from said fusible material, said distance being greater than twice the thickness of the fusible material.

5. The sensor as defined in claim 2, wherein the fusible material is of a length of at least 0.25 inches.

6. The sensor as defined in claim 2, wherein the second conductor portions protrude from the body to form extensions.

7. The sensor as defined in claim 6, wherein the extensions, the second conductor portions, the fusible material and the tapered portion, peripherally enclose the void.

* * * * *